US005205000A

United States Patent [19]

Xia et al.

[11] Patent Number: 5,205,000

[45] Date of Patent: Apr. 27, 1993

[54] DUAL WATER-LEVEL TOILET FLUSHING APPARATUS

[76] Inventors: Frank Z. Xia; Mary Z. Luo; Jack Y. Zhang, all of 4066 E. Mission Blvd., Pomona, Calif. 91766

[21] Appl. No.: 845,165

[22] Filed: Mar. 3, 1992

[51] Int. Cl.[5] ..... E03D 1/14; E03D 1/35

[52] U.S. Cl. ..... 4/324; 4/325; 4/415; 4/402; 4/395

[58] Field of Search ..... 4/324, 325, 415, 402, 4/394, 395; 137/397, 389, 390, 410

[56] References Cited

U.S. PATENT DOCUMENTS

| | | | |
|---|---|---|---|
| 2,526,294 | 10/1950 | Stegeman | 4/325 |
| 4,080,669 | 3/1978 | Biggerstaff | 4/325 |
| 4,145,774 | 3/1979 | Sullivan | 4/325 |
| 4,305,163 | 12/1981 | Raz | 4/394 |
| 4,811,432 | 3/1989 | Harris | 4/325 |
| 4,825,478 | 5/1989 | Harris | 4/415 |
| 4,941,214 | 7/1990 | Harris | 4/415 |
| 5,023,960 | 6/1991 | Ratanagsu | 4/324 |
| 5,142,710 | 9/1992 | Olson | 4/325 |

*Primary Examiner*—Henry J. Recla
*Assistant Examiner*—Charles R. Eloshway
*Attorney, Agent, or Firm*—Albert O. Cota

[57] ABSTRACT

A dual water-level toilet flushing apparatus (10) that allows a toilet user to easily and quickly select either a partial or a full toilet flush. The partial flush which is normally preset is recommended for flushing liquid waste while the full flush is recommended for flushing solid waste. The apparatus (10) which is easily installed and requires no modification to the toilet water tank (60) consists of three major elements: an overflow tube sleeve (12) that attaches to an overflow tube (64) and that has swivelly attached the back end of a floating inverted pendulum (20). The front of the pendulum is attached, via a pendulum/flapper valve link (24), to the front of a toilet flapper valve (30) having its back swivelly attached to the bottom of the overflow tube (64). To effect a partial flush, the toilet flush handle (68) is depressed and immediately released; to effect a full flush the handle (60) is depressed and held for a few seconds.

12 Claims, 6 Drawing Sheets

DUAL WATER-LEVEL TOILET FLUSHING APPARATUS

TECHNICAL FIELD

The invention pertains to the general field of toilet flushing apparatuses and more particularly to a dual water-level flushing apparatus that allows the toilet user to select either a preset partial flush or a full flush.

BACKGROUND ART

The modern toilet consists of three major parts, (1) an upper toilet water tank which functions as a water reservoir, (2) a lower part consisting of a bowl that also contains a volume of water into which is deposited human waste products and (3) a flushing apparatus. Once the waste products have been deposited, they are flushed away by activating the flushing apparatus which allows the water held in the upper tank section to flow into the bowl. The waste products are flushed into a collection system, such as a sewer system or septic tank, after which the water tank and bowl are refilled in preparation for a subsequent flush.

Waste products consist of solid and liquid waste. In presently available toilets, one flush is utilized to carry away both solid and liquid waste, even for occasions when there is only liquid waste in the bowl. In these toilets, a complete flush is effected with each flush and the total contents of the upper tank section is drained into the bowl and then out into the sewer system.

One of the most popular toilet flushing apparatuses uses a ball-cock valve assembly that controls the inlet of water into the toilet water tank. A float ball is connected to the ball-cock valve by means of a float arm. As the toilet tank fills with water, the buoyant float ball rises in the tank section, the motion being transmitted to the ball-cock through the float arm until at a predetermined water level the ball-cock assembly shuts off the water inlet to the tank. In most toilets, the water level in the water tank may be adjusted by means of a screw set mechanism provided in the ball-cock assembly. This adjustment, however, is limited in range and requires that the tank lid be lifted to obtain access to the ball-cock. Once the water level in the tank is set, the adjustment is usually thereafter ignored. The same volume of water is therefore discharged form the tank every time that the flushing apparatus is tripped, regardless of the volume which may be actually required on a particular occasion in order to successfully flush the toilet.

It is a well known fact that the largest use of water in most households and in many office buildings is for flushing toilets. Because the flushing is carried out with the full capacity of the water in the water tank the water usage is wasteful and not required. Considerable interest has been centered on reducing the water used when toilets are flushed, especially at times and in places when there is a water deficiency or periods of drought.

Several water saving methods are in current use to conserve water during the toilet flushing operation. One such method is to place a filled water bag or a solid object, such as a brick, in the water tank to displace an equivalent volume of water to thus reduce the volume of water consumed with each flushing. Another common method is to lower the float valve to allow the ball-cock valve to close at a reduced water level. These methods to conserve water in many cases are self-defeating, in that, the effectiveness of the partial flush is diminished, because it may be necessary to flush twice to effect a sanitary flush. Additionally, such methods represent a compromise in that once the volume of water is set, it is not readily adjustable.

In summary, the design of the prior art apparatuses with respect to the design of the instant invention are relatively complicated, require modification of the existing hardware and in some cases, the toilet tank itself requires modification.

A search of the prior art did not disclose any patents that read directly on the claims of the instant invention however, the following U.S. patents were considered related:

| U.S. PAT. NO. | INVENTOR | ISSUED |
|---|---|---|
| 4,945,581 | Harris | 7 August 1990 |
| 4,937,894 | Hill, et al | 3 July 1990 |
| 4,910,812 | Comparetti | 27 March 1990 |
| 4,837,867 | Miller | 13 June 1989 |

The Harris patent discloses a flush tank water saver that has an elongated semi-circular base that is clamped to the overflow tube. The base has an operating lever on pivots that is close to the flapper valve pivots. This lever engages the flapper valve at its center and pushes it in its direction of travel. The lever is operated to close the valve by means of a float mounted on the other side of the overflow tube. The float operates a float lever connected to the valve and a stop for the float is brought into place by the flush lever. When the flush handle is depressed for two seconds, the float engages the stop and is inoperative for that flush to thus, effect a full flush.

The Hill patent discloses a dual-flush toilet valve assembly that allows selection of either a partial or a complete flush of a toilet water tank. The invention features a hollow valve member having both a small vent bore and a larger opening. The valve is selectively pivoted in a first or a second direction depending upon which one of two activation levers is depressed. Opening the valve allows trapped air to vent from within the hollow valve. The inflowing water eventually imparts a negative buoyancy to the valve assembly allowing it to seat in the drain valve and seal the toilet tank prior to the complete discharge of the contained water. Alternatively, opening the valve allows less air to escape and therefore, the valve does not achieve a negative buoyancy. Therefore, the entire water contents of the toilet tank is allowed to drain before the valve is sealed onto the valve seat of the drain valve.

The Comparetti patent discloses a semi-flush valve mechanism in a toilet tank that is provided with a two way flush operating handle. If the handle is pressed downward, the toilet tank provides a complete flush in the conventional way. If the handle is pressed upwardly, the toilet tank provides a partial flush. A pivotally extended vane on a tilted valve assembly receives a water stream from a refill tube. This action restores the toilet tank valve assembly to its closed upright position to allow the partial flush.

The Miller patent discloses a toilet dual-flush system that allows a full flush or a partial flush to carry away liquid wastes. The system functions by partially opening the main valve, located in the water holding tank of the toilet, for a period of time that is determined by the operator. When the valve is opened slightly, downward pressure on the valve and suction forces the water passing between the valve and valve seat to exert a downward force on the valve that causes the valve to pull back into a closed position after opening. When the valve is raised to a position where its buoyancy exceeds the downward pressure a full flush is effected. The system includes the means to limit the upward lifting of the valve by limiting the lengthwise travel of a cord attached to the valve. The cord is attached on its other end to a flush handle and lever.

For background purposes and as indicative of the art to which the invention relates, reference may be made to the following remaining patents found in the search:

| U.S. PAT. NO. | INVENTOR | ISSUED |
|---|---|---|
| 5,005,225 | Pasquin | 9 April 1991 |
| 5,004,462 | Mahler | 2 April 1991 |
| 5,003,644 | Huang | 2 April 1991 |
| 5,003,643 | Chung | 2 April 1991 |
| 4,969,218 | Comparetti | 13 November 1990 |
| 4,953,237 | Perkins | 4 September 1990 |
| 4,945,580 | Schmitt, et al | 7 August 1990 |
| 4,864,665 | Toltzman | 12 September 1989 |
| 4,829,605 | Agostino | 16 May 1989 |
| 4,817,216 | Auman | 4 April 1989 |
| 4,042,982 | Contreras | 23 August 1977 |

DISCLOSURE OF THE INVENTION

The dual water-level toilet flushing apparatus allows a person using a toilet to quickly and easily select either a partial flush recommended for liquid waste or a full flush recommended when disposing solid waste. The apparatus is normally preset to provide the partial flush. However, the partial flush can be easily circumvented by holding down the toilet flush handle for several seconds or by pressing on the handle two or three times.

The apparatus is designed to be included as original equipment in toilet tanks or to easily replace existing toilet flushing apparatuses. No special tools or skills are required to make the replacement.

The apparatus operates in combination with a toilet tank drain, a toilet flush handle that is operated by a chain and flush arm, a flapper valve and an overflow tube. In its basic design configuration, the apparatus consists of:

an overflow tube sleeve consisting of an elongated structure that includes a means for being held in place around the overflow tube, a pendulum/flapper valve link that has an upper section having a pendulum slot and a lower end that has a means for pivotally being attached to a front mounting tab located on the flapper valve. The flapper valve also includes a pair of back mounting tabs that are inserted over a respective pair of flapper valve hooks attached near the bottom section of the overflow tube, and a floatable inverted pendulum having a back section that includes a means for being swivelly attached to the upper section of the overflow tube sleeve and a front section that is attached to the pendulum slot on the pendulum flapper valve link.

The dynamic member of the pendulum is a cavity support structure that incorporates four longitudinally aligned cavities of equal volume. Commencing from one end, three of the sequential cavities face upwardly and the fourth cavity located on the opposite end, faces downwardly and is primarily an air cavity. The four cavities are sized to provide a volumetric ratio of 3:1 which was determined through an analytical study to provide an optimum operational ratio of buoyancy and gravity. The buoyancy and the force of gravity of the structure then controls the timing for the opening and closing of the flapper valve for both the partial flush and the full flush.

In view of the above disclosure, it is the primary object of the invention to provide an apparatus that allows a toilet user to easily and quickly select either a partial toilet flush or a full toilet flush. In addition to the primary object, it is also an object of the invention to provide an apparatus that:

is simple to use, saves water while retaining the effectiveness of the flush for sanitation purposes, is easily installed and requires no adjustments, tools or modification of the toilet water tank, improves the reliability and seating capability of the toilet flapper valve by providing a weighted, quick valve closure.

can be attached to overflow tubes of various outside diameters, allows the toilet tank water level to be initially set to compensate for various sizes of toilet water tanks, can be used to modify existing toilet water tanks or can be initially installed in newly manufactured toilets, is designed with components that are not subject to wear to thus provide a high reliability apparatus, and is cost effective from both a manufacturing and consumer viewpoint.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
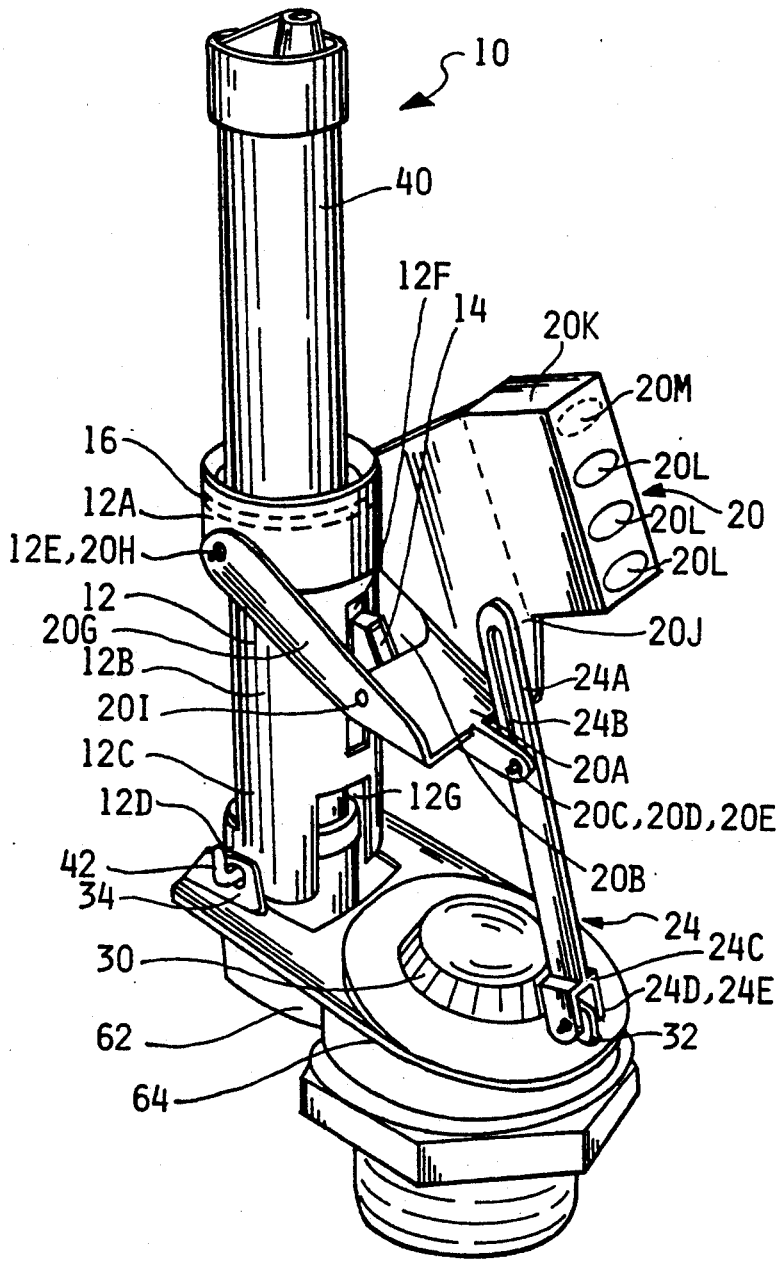
FIG. 1 is a perspective view of the dual water-level toilet flushing apparatus attached to an overflow tube and flapper valve of a conventional toilet.

The best mode for carrying out the dual water-level toilet flushing apparatus 10 is presented in terms of a preferred embodiment that is designed to allow a toilet user to select either a normally preset partial flush or to circumvent the normal flush and select a full flush. The partial flush is recommended when flushing liquid waste and the full flush when flushing solid waste.

The preferred embodiment of the apparatus 10 as shown in FIGS. 1–13 is comprised of three major elements: an overflow tube sleeve 12, a floatable inverted pendulum 20 and a pendulum/flapper valve link 24. The apparatus is designed to be installed in a toilet water tank 60 that incorporates a flapper valve 30, an overflow tube 40, and a flush chain 70 that is controlled through a flush arm 72 connected to a flush handle 74. All the major elements of the apparatus may be constructed of plastic or a non-corrosive metal with plastic preferred.

Figure 2:
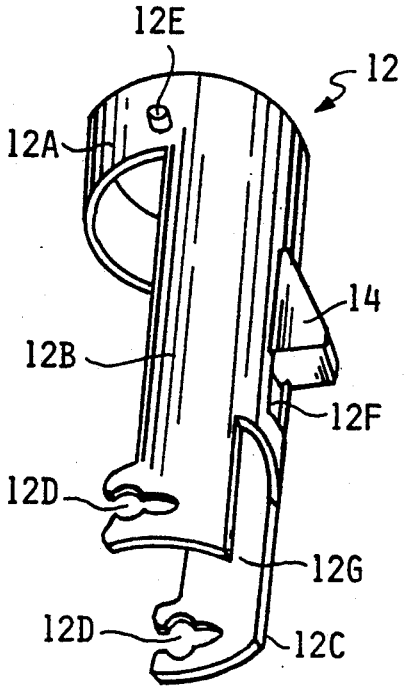
FIG. 2 is a perspective view of the overflow tube sleeve with an adjustable water-level slide attached.
Figure 3:
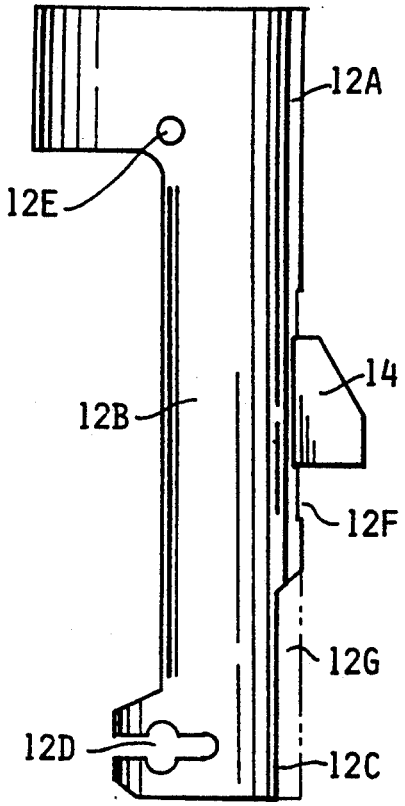
FIG. 3 is a side elevational view of the overflow tube sleeve with the adjustable water-level slide attached.

The overflow tube sleeve 12 is shown attached to the overflow tube 40 in FIG. 1 and detached in FIGS. 2 and 3. The sleeve consists of an elongated structure that includes a means for allowing it to be held in place around the overflow tube 40. As best shown in FIG. 2, the upper section is comprised of a closed circular structure 12A that is sized to fit around the overflow tube 40. Extending laterally from each side of the structure 12A is a pendulum pivot pin 12E. At the sleeve's lower section 12C is located a parallel pair of pin slots 12D that open from the back. The slots are sized to be captively held over a respective pair of flapper valve hooks 42 located near the bottom of the overflow tube 40. The slots, in combination with the circular structure, provide the means by which the sleeve 12 is held in place around the overflow tube.

The sleeve 12 includes a flapper valve clearance slot 12G that projects upwardly from its front-bottom section. This slot provides a clearance for the back of the flapper valve 30 when the valve is pivotally rotated up (open) or down (closed).

Figure 9:
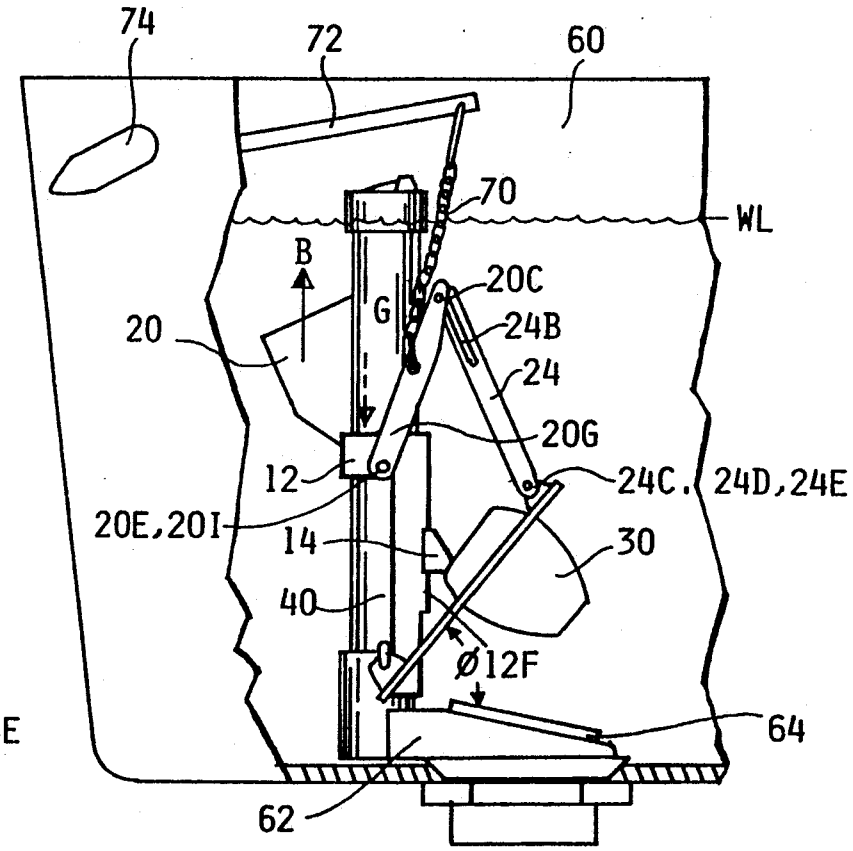
FIG. 9 is a side elevational view of the apparatus attached to a toilet tank with the floatable inverted pendulum and pendulum/flapper valve as would be configured when the flush handle is initially pressed when the preset partial flush is activated.

In the preferred embodiment, the overflow tube sleeve incorporates a water-level slide slot 12F that extends vertically from the front of the center section 12B as best shown in FIG. 2. The slot is sized to captively engage an adjustable water-level slide 14. This slide is positioned along the slot to limit the counterclockwise opening angle $\phi$ of the flapper valve as shown in FIG. 9. Thus, the amount of water required for a partial flush can be selectively regulated. To allow the overflow tube sleeve 12 to accommodate overflow tubes of various outside diameters, a sleeve spacer 16 is used. This sleeve spacer as shown in FIG. 1, is positioned inside the closed circular structure 12A of the sleeve 12 and is selectively sized to allow the sleeve to be substantially centered around the overflow tube 40.

Figure 7:
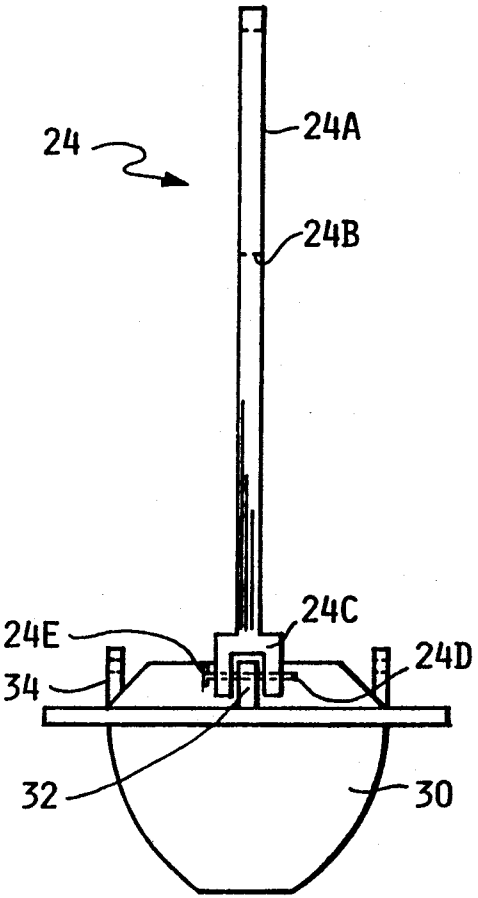
FIG. 7 is a front elevational view of the pendulum/-flapper valve link attached to the flapper valve.
Figure 6:
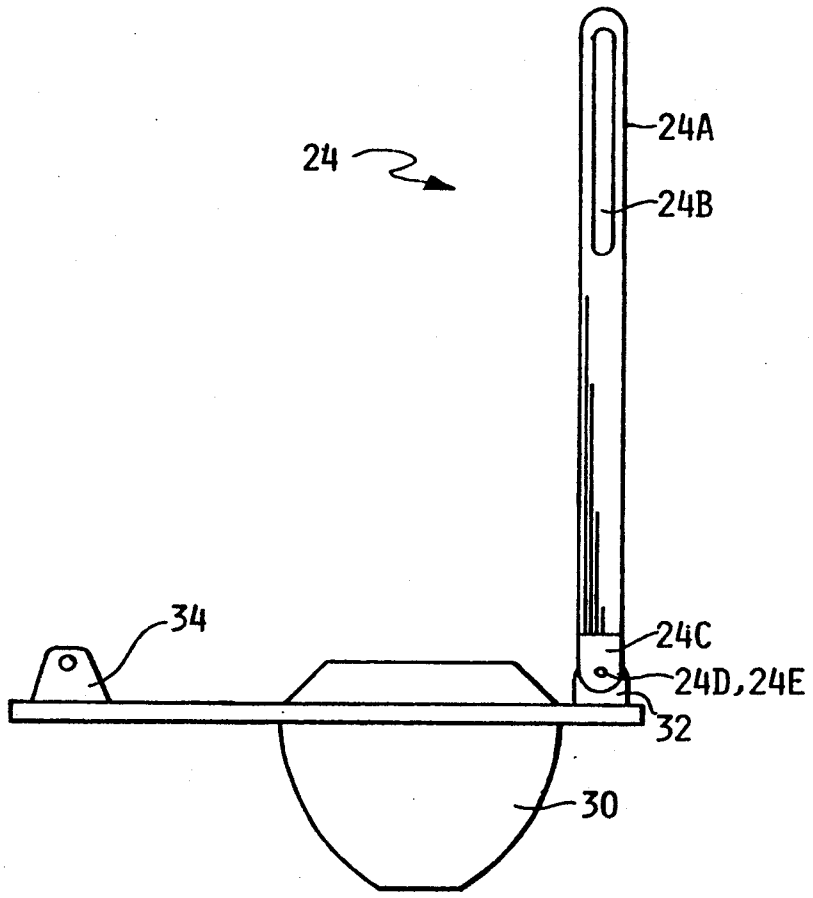
FIG. 6 is a side elevational view of the pendulum/-flapper valve link attached to a flapper valve.

The pendulum/flapper valve link 24 provides the interface between the floatable inverted pendulum 20 and the flapper valve 30 as shown in FIG. 1. The link 24 as shown best in FIGS. 6 and 7, is comprised of a narrow elongated structure that includes at its upper section 24A a pendulum slot 24B. The lower end of the link includes a means for pivotally being attached to a front mounting tab 32 on the flapper valve 30. In the preferred embodiment this attachment means comprises a link clevis 24C that includes a clevis pin bore 24D. The clevis is then attached to the flapper valve mounting tab by means of a clevis pin 24E as best shown in FIG. 7. The back of the flapper valve includes a pair of back mounting tabs 34 that are swivelly inserted over a respective pair of flapper valve hooks 42 attached near the bottom section of the overflow tube 40.

The primary functional element and key to the inventive apparatus 10 is the floatable inverted pendulum 20 which is shown functionally attached to the apparatus 10 in FIG. 1. The pendulum, which is also shown detached in FIGS. 4, 5, and 13, consists of three major members: a lateral support member 20A, a first side support member 20G and a second side support member 20J that includes on its outer side a cavity support structure 20K.

The lateral support member 20A, when attached to the side members 20G and 20J, defines a back extending sleeve clearance slot 20B that allows the pendulum 20 to freely pivot about the pivot pins 12E. At the front end of the lateral support member is located a link clevis 20C that has therethrough a clevis pin bore 20D. The clevis engages the pendulum slot 24B on the pendulum/flapper valve link 24 by means of a clevis pin 20E. This arrangement allows the front end of the lateral support member 20A to traverse up and down within the confines of the pendulum slot 24B when the apparatus 10 is being operated.

The first side support member 20G has a front section lower edge that is attached to one side of said lateral support member 20A and a back section having a pivot pin bore 20H that is pivotally inserted into the respective pendulum pivot pin 12E on the sleeve 12 as shown in FIG. 1. The first side support member also includes a chain bore 20I to where the flush chain 70 that is operated by the flush handle 74 via the flush arm 72 is attached.

Figure 4:
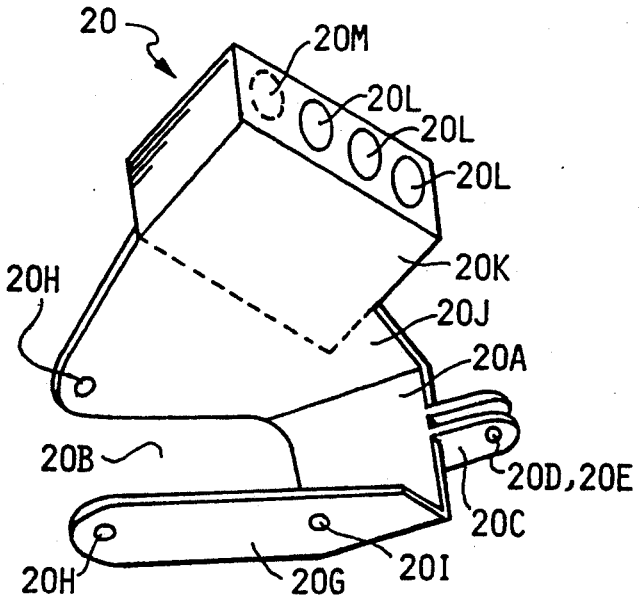
FIG. 4 is a perspective view of the floatable inverted pendulum.

The second side support member 20J also has a front section lower edge that is likewise attached to the other side of the lateral support member 20A and a back section having a pivot pin bore 20H that is pivotally inserted into the respective pendulum pivot pin 12E on the sleeve 12. Attached to the outer side of the second side support structure 20J is the cavity support structure 20K which has at least one upper cavity 20L and at least one lower cavity 20M as best shown in FIG. 4. The cavity support structure 20K timing for the opening and closing of the flapper valve.

Figure 5:
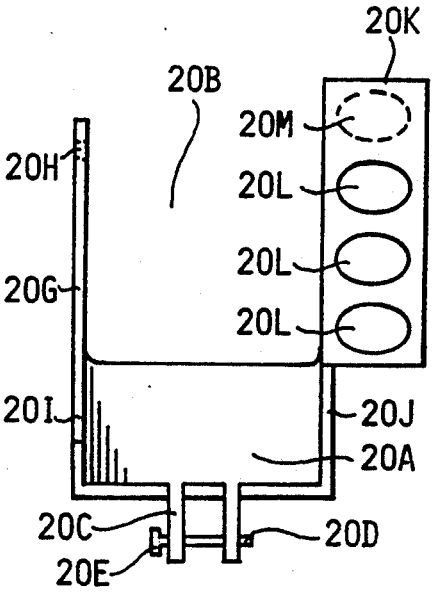
FIG. 5 is a top plan view of the floatable inverted pendulum.

The preferred embodiment of the cavity support structure 20K as shown in FIGS. 4 and 5, consists of four longitudinally aligned cavities of equal volume. Three are upper cavities 20L and one is a lower cavity 20M. The cavity support structure 20K can also be made with one or two upper cavities. However, in this design, the height of the structure must be larger.

Figure 13:
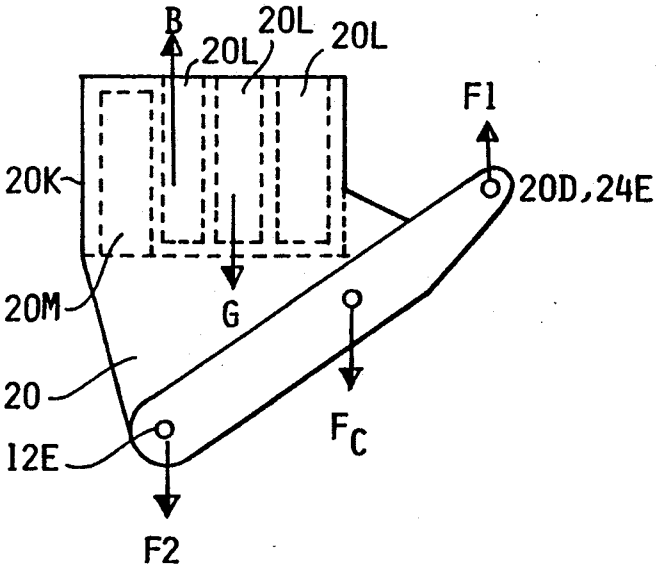
FIG. 13 is a side elevational view of the floatable inverted pendulum when the pendulum is in the partial flush mode showing the centers and forces produced by its buoyancy B and gravity G, the force Fc exerted on the pendulum by the chain and the forces F1, F2 exerted on the pendulum by the pendulum/flapper valve link.

The dynamic operation of the floatable inverted pendulum 20 can best be understood by analyzing the pendulum when the apparatus 10 is operating in the partial flush mode. In this case, the flush handle 74 has been released after the flush handle was initially depressed and the cavity support structure 20K is in a substantially vertical position as shown in FIG. 13.

When the cavity support structure is in a substantially vertical position, the lower cavity 20M is filled with air which causes the buoyancy B of the pendulum 20 to be greater than both the force of gravity G and the force $F_c$ exerted on the pendulum 20 by the chain 70. The cavity 20M also allows the center of the buoyancy B to differ from the center of gravity G when the pendulum is emersed in water. As also shown in FIG. 13, a force $F_1$ and $F_2$ are exerted on the pendulum 20 by the link 24 attached to the pin 24E and the pendulum pivot pins 12E respectively. When all forces are present, the center of gravity G is located to the right of the pendulum pivot pins 12E.

As the water level in the toilet tank drops and part of the pendulum is above the water level, the buoyancy B of the pendulum is progressively reduced. At this same time, the forces applied to the flapper valve 30 through the link 24 become progressively larger. When this force becomes large enough, the flapper valve turns clockwise and seats itself on the toilet tank drain 62 to stop the flow of water.

OPERATION

Figure 8:
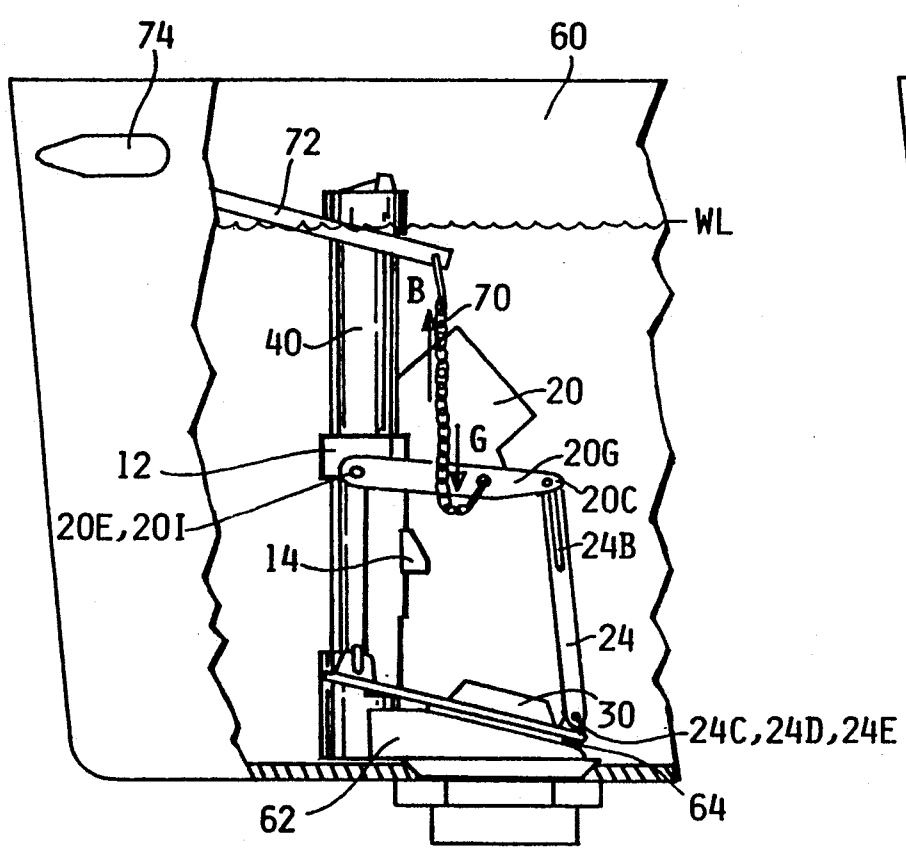
FIG. 8 is a side elevational view of the apparatus attached to a toilet tank with the floatable inverted pendulum and pendulum/flapper valve as would be configured prior to either a partial or full flush.

The dual water-level toilet flushing apparatus 10 is designed to provide a user-selectable preset partial flush or full flush. Prior to either the partial or full flush the water level WL in the toilet tank 60 is at its maximum level and the apparatus 10 is configured as shown in FIG. 8. As shown, the flapper valve 30 is seated on the valve seat 64 of the toilet tank drain 62, the floatable inverted pendulum 20 is floating in a position to the right of the overflow tube 40 and the pin 20E of the link clevis 20C, which is inserted through the bores 20D and through the pendulum slot 24B of the pendulum/flapper valve link 24, is at the top end of the slot.

Partial Flush

The preset partial flush is performed by pressing and immediately releasing the flush handle 74 as is normally done with conventional toilets. When the flush handle is depressed as shown in FIG. 9, the chain 70, via the flush arm 72, pulls upwardly on the first side support member 20G causing the floatable inverted pendulum 20 to rotate to its maximum counterclockwise (CCW) position. At this same time, the flapper valve 30 rotates CCW to its fully open position allowing the water level to drop and flow out the toilet tank drain 62.

Figure 11:
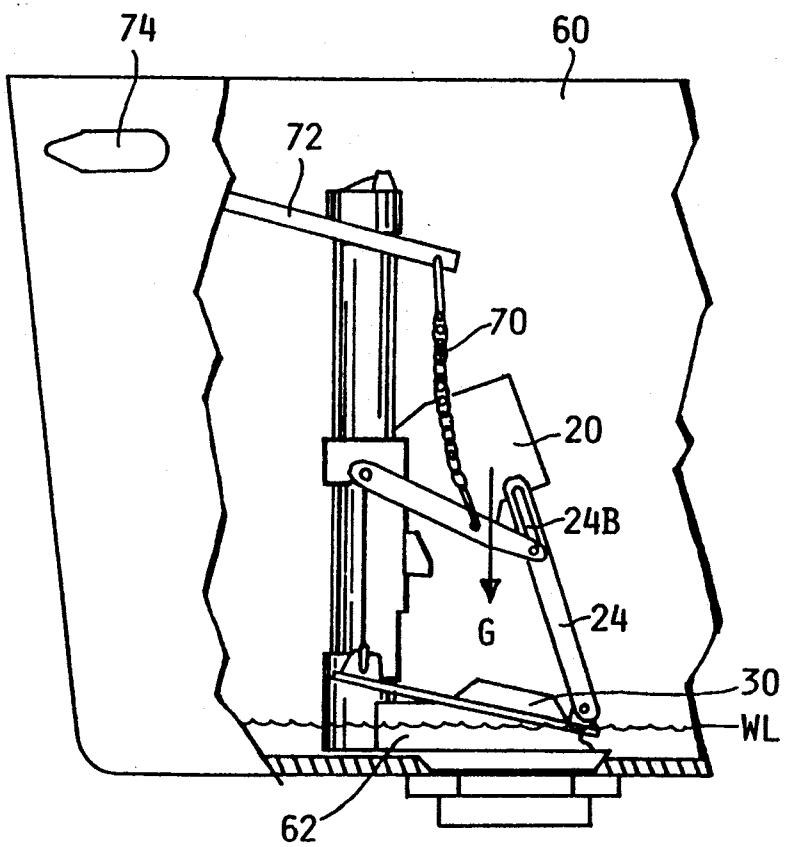
FIG. 11 is a side elevational view of the apparatus attached to a toilet tank with the floatable inverted pendulum and pendulum/flapper valve as would be configured when the water level in the toilet tank has dropped to a level below the pendulum during the performance of the preset partial flush.
Figure 10:
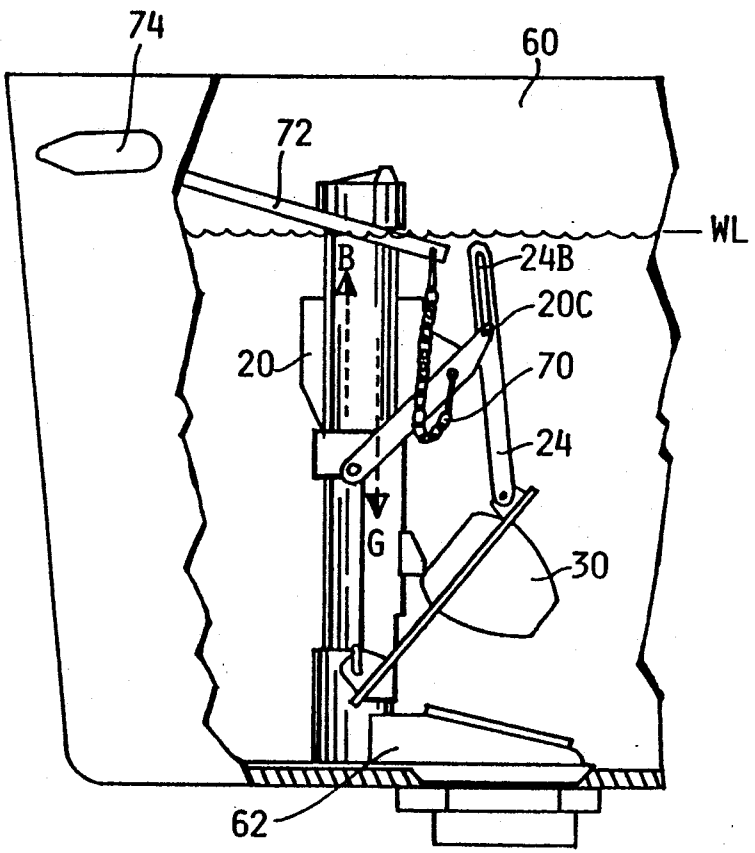
FIG. 10 is a side elevational view of the apparatus attached to a toilet tank with the floatable inverted pendulum and pendulum/flapper valve as would be configured when the flush handle is released during the performance of the preset partial flush.

Upon the release of the flush handle 74, as shown in FIG. 10, the force provided by the chain 70 is released causing the buoyant inverted pendulum 20 to rotate CW to a substantially vertical position. This action occurs because the center of the buoyancy B and the center of gravity G of the pendulum are located in different positions. At the same time, the clevis 20C moves to the bottom end of the pendulum slot 24B and the water continuous to flow out the toilet tank drain 62. When the water level drops to a level below the pendulum, as shown in FIG. 11, the pendulum loses its buoyancy B and the force of gravity G and the water remaining in the cavities of the pendulum take over causing the slotted link 24 to push on and fully rotate the flapper valve 30 CW to its closed position to stop the flow of water through the toilet tank drain 62.

Full Flush

Figure 12:
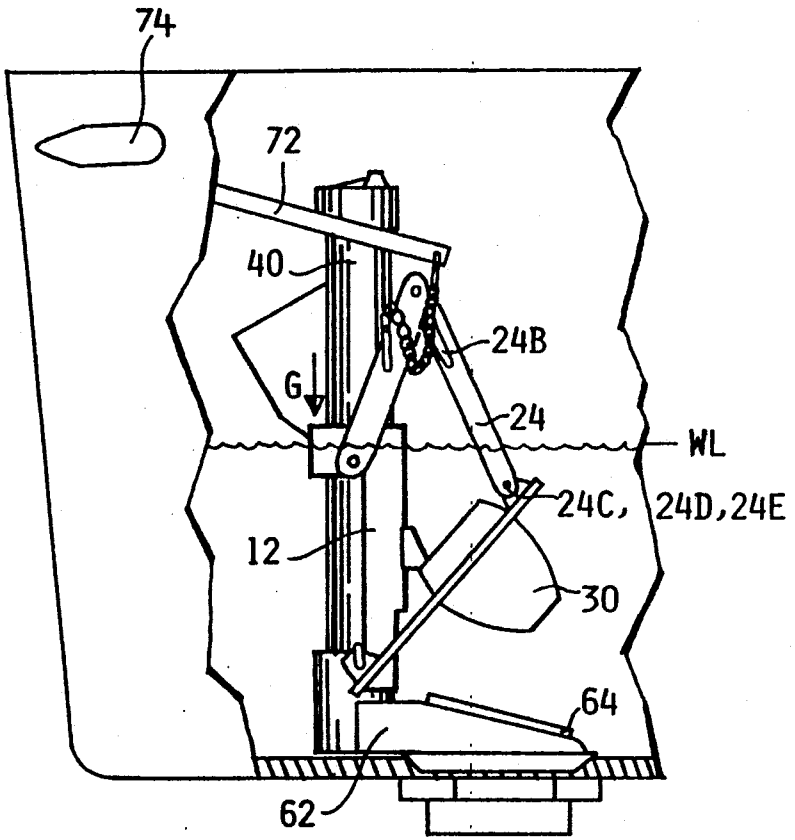
FIG. 12 is a side elevational view of the apparatus attached to a toilet tank with the floatable inverted pendulum and pendulum/flapper valve as would be configured when the full flush is activated.

The full flush is performed by pressing and holding down the flush handle 74 for several seconds. When the flush handle is depressed as shown in FIG. 9, the chain 70 via the flush arm 72, pulls upwardly on the first side support member 20G causing the floatable inverted pendulum 20 to rotate to its maximum counterclockwise (CCW) position. At this same time, the flapper valve 30 rotates CCW to its fully open position allowing the water level to drop and flow out the toilet tank drain 62. By the time the flush handle 74 is released as shown in FIG. 12, the water level will have dropped to a level below the pendulum 20. However, the pendulum remains in its furthest CCW position due to the location of the force of gravity G as also shown in FIG. 12. When the water level drops further to a level that is below the flapper valve 30, the flapper valve loses its buoyancy and commences to rotate CW. At this same time, by means of the pendulum/flapper valve link 24, the flapper valve 30 causes the pendulum 20 to move CW and drop by the force of gravity as shown in FIG. 11, to further aide in the closure and seating of the flapper valve 30 on the toilet tank drain 62.

While the invention has been described in complete detail and pictorially shown in the accompanying drawings it is not to be limited to such details since many changes and modifications may be made in the invention without departing from the spirit and scope thereof. For example, both the overflow tube sleeve 12 and the floatable inverted pendulum 20 may be made of individual members that are assembled with an adhesive or they may be molded as single integral elements. Hence, it is described to cover any and all modifications and forms which may come within the language and scope of the claims.

We claim:

1. A dual water-level toilet flushing apparatus that selectively operates in either a normal, preset partial flush or a full flush and that is designed to be installed in a toilet tank and to function in combination with a toilet tank drain, a toilet flush handle that is operated by a chain and flush arm, a flapper valve having a front mounting tab and a pair of back mounting tabs and an overflow tube having a bottom section, said apparatus comprising:

a) an overflow tube sleeve consisting of an elongated structure that includes means for being held in place around the overflow tube, b) a pendulum/flapper valve link that has an upper section having a pendulum slot and a lower end that has means for pivotally being attached to the front mounting tab of the flapper valve, where the back mounting tabs of the flapper valve are swivelly inserted over a respective pair of flapper valve hooks attached near the bottom section of the overflow tube and, c) a floatable inverted pendulum having a back section that includes a means for being swivelly attached to the upper section of said overflow tube sleeve, and a front section that is attached to the pendulum slot on said pendulum/flapper valve link, where said pendulum includes means to be attached to and operated by the toilet flush handle via the chain and flush arm, and where said pendulum is designed to control the net torque about the point of attachment of said pendulum to said overflow tube created by the force produced by its buoyancy and the opposite applied force of gravity, where these forces then allow said pendulum to control the timing of the opening and closing of the flapper valve.

2. A dual water-level toilet flushing apparatus that selectively operates in either a normal, preset partial flush or a full flush and that is designed to be installed in a toilet tank and to function in combination with a toilet tank drain, a toilet flush handle that is operated by a chain and flush arm, a flapper valve and an overflow tube, said apparatus comprising:

a) an overflow tube sleeve having means for being held in place around the overflow tube and having near its upper section on each side, a laterally extending pivot pin, b) a pendulum/flapper valve link having a longitudinal pendulum slot in its upper section and a lower end having means for pivotally being attached to a front mounting tab on the flapper valve, where the back of the flapper valve has a pair of back mounting tabs that are swivelly attached to a pair of flapper valve hooks attached near the bottom section of the overflow tube, c) a floatable inverted pendulum comprising:

(1) a lateral support member having at its front end a clevis that engages and traverses the pendulum slot on said pendulum/flapper valve link, s (2) a first side support member attached to an outer side of said lateral support member and having a pivot pin bore located at its back section that is pivotally mounted over the respective pendulum pivot pin on said overflow tube sleeve, and further having a flush chain bore to where the chain that is operated by the flush handle via the chain and flush arm is attached, (3) a second side support member attached to the other side of said lateral support member and having a pivot pin bore located at its back section that is pivotally mounted over the respective pendulum pivot pin on said overflow tube sleeve, and (4) a cavity support structure attached to an outer side of said second side support member, said structure having at least one upper cavity and at least one lower cavity of less volume, where said cavity support structure controls the net torque caused by the force of its buoyancy and the opposite applied force of gravity about its point of attachment to said sleeve, where these forces then allow said pendulum to control the timing of the opening and closing of the flapper valve, and wherein the flushing is accomplished by performing the following steps:

a) partial flush—press and immediately release the flush handle; when the handle is depressed, the chain via the flush arm pulls upwardly on the floatable inverted pendulum, causing the pendulum to rotate to a maximum counterclockwise position and causing the flapper valve to rotate CCW to a fully open position at which time the water level begins to drop and flow out the toilet tank drain, upon releasing the toilet flush handle, the chain force is released clockwise (CW) to a substantially vertical position, the pin moves to the bottom end of the pendulum slot on the pendulum/flapper valve link and the center of gravity of said pendulum shifts to the right and when the water drops to a level below said pendulum, said pendulum loses its buoyancy and the force of gravity of said pendulum and the water remaining in the at least one upper cavity of said pendulum rotates to cause said slotted link to push on and fully rotate the flapper valve CW to its closed position to stop the flow of water through the toilet tank drain, b) full flush—press and hold down the flush handle for several seconds; during the time the handle is depressed, the chain via the flush arm pulls upwardly on said inverted pendulum causing said pendulum to rotate to its maximum CCW position, and the flapper valve to rotate CCW to its fully open position at which time the water level begins to drop and flow out the toilet tank drain, by the time the flush handle is released, the water level will have dropped to a level below said pendulum but said pendulum remains in its furthest CCW position because the center of the force of gravity is on the left side of the overflow tube, when the water drops further to a level below the flapper valve, the valve loses its buoyancy and commences to rotate CW, at this same time, by means of said pendulum/flapper valve link, the valve causes said pendulum to move CW and drop by the force of gravity to further aide in the closure and seating of the flapper valve on the toilet tank drain to stop the flow of water.

3. The apparatus as specified in claim 2 wherein the upper section of said overflow tube sleeve is comprised of a closed circular structure sized to fit around the overflow tube.

4. The apparatus as specified in claim 2 wherein said overflow tube sleeve further comprises a water-level slide slot extending vertically from a front-center section located on said sleeve, where said slot captively engages an adjustable water-level slide that is positioned along the slot to limit the counterclockwise opening angle of the flapper valve to thus allow the amount of water available for a partial flush to be selectively regulated.

5. The apparatus as specified in claim 2 wherein said overflow tube sleeve further comprises a flapper valve clearance slot projecting from a front-bottom section on said sleeve, where said slot provides a clearance for the flapper valve when the valve is pivotally rotated up or down.

6. The apparatus as specified in claim 3 further comprising a sleeve spacer positioned inside the closed circular structure, where said spacer is selectively sized to allow said sleeve to be substantially centered around the overflow tube.

7. The apparatus as specified in claim 6 wherein the inside diameter of said sleeve spacer is selected to accommodate the various outside diameters of overflow tubes.

8. The apparatus as specified in claim 2 wherein said means for holding said overflow tube sleeve around the overflow tube comprises a pair of pin slots open from the back and sized to be captively held on a respective pair of flapper valve hooks located on the overflow tube.

9. The apparatus as specified in claim 2 wherein said means for pivotally attaching the lower end of said pendulum/flapper valve link to the flapper valve is by attaching to the front end of said link a clevis that is attached to the front mounting tab on the flapper valve by a clevis pin.

10. The apparatus as specified in claim 2 wherein the lateral support structure of said floatable inverted pendulum defines a backward extending sleeve clearance slot that allows said floatable inverted pendulum to freely pivot about the pivot pins.

11. The apparatus as specified in claim 2 wherein the cavity support structure comprises four longitudinally aligned cavities of equal volume, where three of the aligned cavities having upward openings and the fourth cavity having a lower opening.

12. The apparatus as specified in claim 2 wherein when said floatable inverted pendulum operates in the partial flush mode and the flush handle has been released, said pendulum is in a substantially vertical position and the lower cavity is filled with air causing the buoyancy of the pendulum to be greater than both the force of gravity and the force exerted on the pendulum by the flush chain, where the placement of the lower cavity allows the center of the buoyancy to differ from the center of gravity when the pendulum is immersed in water, where when additional forces from said pendulum/flapper valve link and from the pendulum pivot pins of said overflow tube sleeve are applied to said pendulum, the center of gravity is to the right of the pendulum pivot pins, and when the water level begins to drop and part of said pendulum is above the water line, the buoyancy of said pendulum is progressively reduced while at the same time, the forces applied to the flapper valve through said pendulum/flapper valve link becomes progressively larger, when these forces exceed the buoyancy of the pendulum, the flapper valve pivots clockwise and seats on the toilet tank drain to stop the flow of water.

* * * * *